US011181299B2

(12) United States Patent
Rechlin

(10) Patent No.: US 11,181,299 B2
(45) Date of Patent: Nov. 23, 2021

(54) A.C. DRAIN LINE CLEANING NOZZLE

(71) Applicant: Neil Rechlin, Davenport, FL (US)

(72) Inventor: Neil Rechlin, Davenport, FL (US)

( * ) Notice: Subject to any disclaimer, the term of this patent is extended or adjusted under 35 U.S.C. 154(b) by 0 days.

(21) Appl. No.: 17/082,006

(22) Filed: Oct. 27, 2020

(65) Prior Publication Data

US 2021/0041138 A1 Feb. 11, 2021

Related U.S. Application Data

(63) Continuation-in-part of application No. 16/224,726, filed on Dec. 18, 2018, now Pat. No. 10,850,312, which is a continuation-in-part of application No. 15/893,356, filed on Feb. 9, 2018, now Pat. No. 10,799,921.

(51) Int. Cl.

| | |
|---|---|
| ***F24F 13/22*** | (2006.01) |
| ***B08B 9/032*** | (2006.01) |
| ***B08B 9/027*** | (2006.01) |
| *E03C 1/308* | (2006.01) |
| *E03C 1/304* | (2006.01) |

(52) U.S. Cl.

CPC ..... *F24F 13/222* (2013.01); *B08B 9/027* (2013.01); *B08B 9/0321* (2013.01); *B08B 2209/032* (2013.01); *E03C 1/304* (2013.01); *E03C 1/308* (2013.01); *F24F 2013/227* (2013.01); *F24F 2221/225* (2013.01)

(58) Field of Classification Search

CPC ..... F24F 13/222; F24F 2013/27; F24F 2013/227; F24F 2221/225; B08B 9/0321; B08B 2209/032; B08B 9/027; E03C 1/308; E03C 1/304

See application file for complete search history.

(56) References Cited

U.S. PATENT DOCUMENTS

| | | | | |
|---|---|---|---|---|
| 5,421,904 | A * | 6/1995 | Carlson | B08B 9/0321 134/167 C |
| 7,624,756 | B1 * | 12/2009 | Coogle | F24F 13/222 137/240 |
| 8,752,865 | B1 * | 6/2014 | Coogle | F24F 13/222 285/12 |
| 9,010,355 | B1 * | 4/2015 | Achez | B08B 3/04 137/238 |
| 9,476,658 | B1 * | 10/2016 | Rojas | F24F 13/222 |
| 2014/0062077 | A1 * | 3/2014 | Hurley | F24F 13/222 285/7 |

* cited by examiner

*Primary Examiner* — Benjamin L Osterhout
(74) *Attorney, Agent, or Firm* — Cygnet IP Law, P.A.; Stephen W. Aycock, II

(57) ABSTRACT

A drain line cleaning nozzle comprising a first end and a cylindrical portion connected to the first end is described. The cylindrical portion of the nozzle having a diameter that is configured to fit within a pipe. The drain line cleaning nozzle can also include a tapered portion connecting the cylindrical portion to a second end. The second end of the nozzle is configured to couple to a hose. The tapered portion is offset from the second end of the nozzle and is configured to fit within a plumbing connection and engage, via an interference fit, an opening of the plumbing connection connected to the pipe.

3 Claims, 9 Drawing Sheets

A.C. DRAIN LINE CLEANING NOZZLE

CROSS REFERENCE TO RELATED APPLICATIONS

This application is a continuation-in-part of application Ser. No. 16/224,726, filed on Dec. 18, 2018, which is a continuation-in-part of application Ser. No. 15/893,356, filed on Feb. 9, 2018, which issued as U.S. Pat. No. 10,799,921 on Oct. 13, 2020.

TECHNICAL FIELD

Embodiments relate generally to drain line cleaning devices and more particularly to a device and kit for cleaning air conditioner condensate drain lines.

BACKGROUND

Condensate drain lines can often be difficult to clean due to the location of air handlers (e.g., in an attic) and limited accessibility to the condensate drain line at or near the source of condensate (e.g., the air handler).

Embodiments were conceived in light of the above-mentioned problems and limitations, among other things.

SUMMARY

Some implementations can include a drain line cleaning nozzle comprising a first end and a cylindrical portion connected to the first end. The cylindrical portion of the nozzle having a diameter that is configured to fit within a pipe. The drain line cleaning nozzle can also include a tapered portion connecting the cylindrical portion to a second end. The second end of the nozzle is configured to couple to a hose. The tapered portion is offset from the second end of the nozzle and is configured to fit within a plumbing connection and engage, via an interference fit, an opening of the plumbing connection connected to the pipe.

The cylindrical portion of the nozzle can have a length of 9±1 inches. The cylindrical portion can have an outer diameter of about 0.7±0.2 inches and an inter diameter of 0.5±0.1 inches. The second end of the nozzle is configured to couple to an intermediate member. The intermediate member is configured to couple to a valve that is configured to couple to a hose. The first end of the nozzle includes one or more flexible baffles configured to engage a sidewall of a drain line inserted into the plumbing connection.

DETAILED DESCRIPTION

Figure 1:
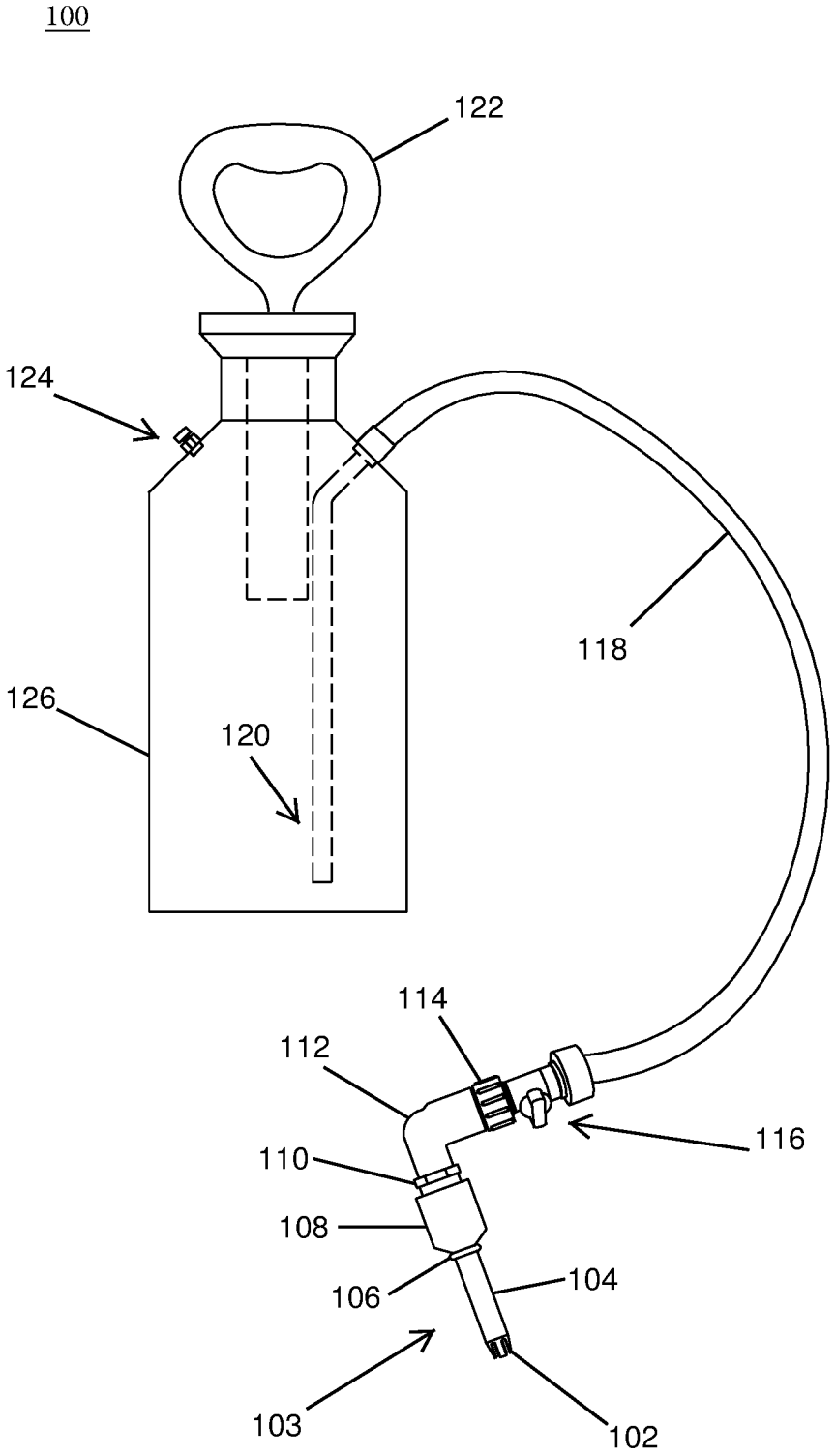
FIG. 1 shows a side elevation view of a drain cleaning device in accordance with some implementations.

FIG. 1 shows a side elevation view of a drain cleaning device 100 in accordance with some implementations. The drain line cleaning device 100 includes a removable lower section 103 that includes a tapered end 102 that includes apertures forming a serrated edge that can be used to remove excess glue within a drain line by rotating the tapered end 102 within a pipe. The removable lower section 103 also includes a lower portion 104 that is constructed to be inserted within an interior of a condensate drain line. The removable lower section 103 also includes an optional elastomeric gasket 106 to help seal the removable lower section 103 to a condensate drain line. The removable lower section 103 further includes a fluted opening 108 that is operable to connect to a corresponding element 110 on the drain line cleaning device 100 via a threaded connection (e.g., NPT) or operable to serve as a funnel for pouring a cleaning solution (e.g., bleach) into a condensate drain line.

The drain line cleaning device 100 include an angled connector 112 (e.g., a 90 degree connector), a threaded coupler 114, a valve 116, a hose 118, an internal line 120, a pump 122, a pressure relief valve 124, and a tank body 126.

Figure 2:
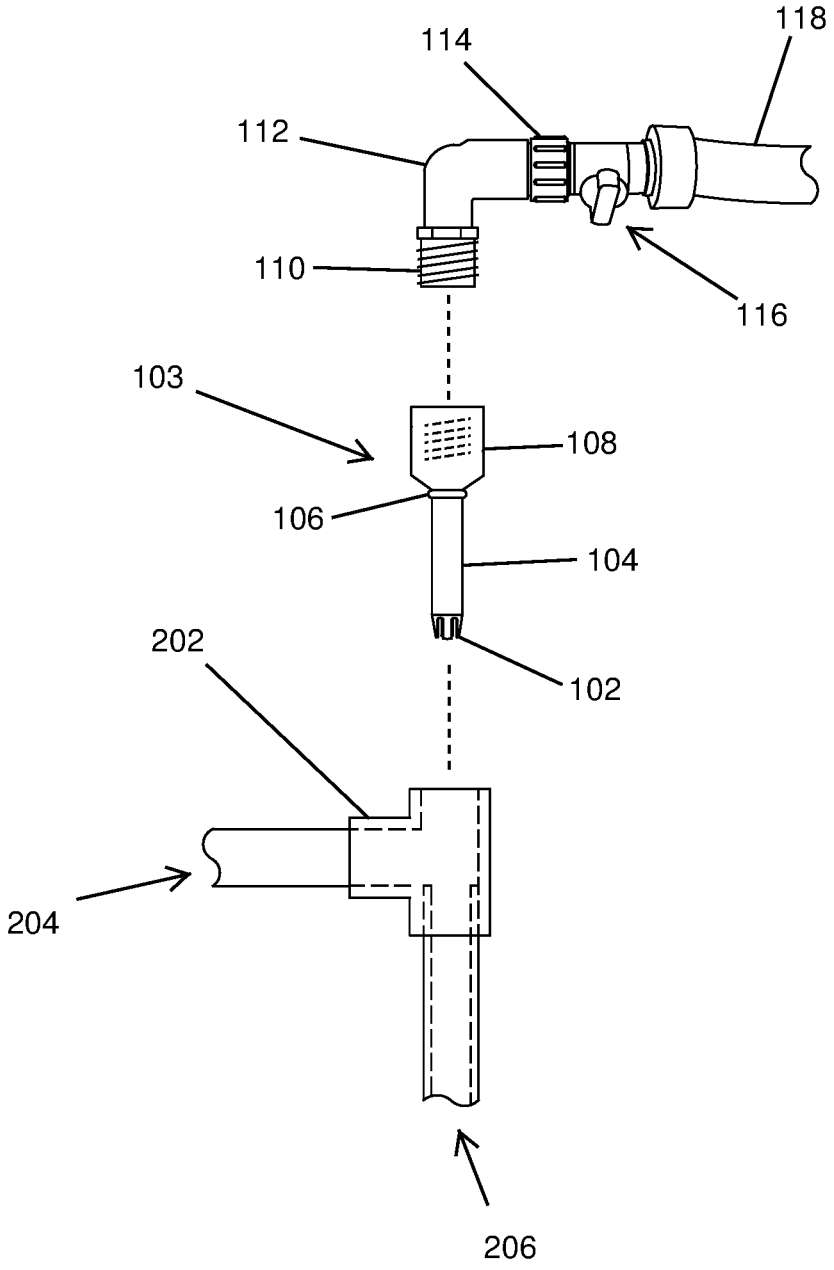
FIG. 2 shows an exploded view of an example condensate drain line cleaning device end section in accordance with some implementations.

As shown in FIG. 2, the drain line cleaning device 100 is constructed to be inserted into a plumbing connector (e.g., tee 202). In FIG. 2, the plumbing connector 202 connects a condensate line 204 coming from a source of condensate (or other fluid) such as an air handler to a drain line 206 that carries the condensate to a drainage area (e.g., outside of a building or into a sewage line, etc.).

The drain cleaning device 100 lower portion 104 is inserted (e.g., via an interference fit) into an opening of the drain line 206 via connector 202.

In operation, air and fluid in the tank 126 is pressurized via the pump 122. When the valve 116 is opened, fluid from the tank 126 flows under the urging of the pressure within the tank 126 out the interior line 120 and through the hose 118 to the lower portion 103 to supply fluid (e.g., water, air, or cleaning fluid such as a bleach solution) to help clean and clear the drain line 206 of buildup (e.g., mold, slime, etc.) or debris, while preventing the fluid from flowing back into condensate line 204.

FIG. 2 shows an exploded view of a condensate drain line cleaning device 100 in accordance with some implementations. FIG. 2 shows the condensate line 204 from the equipment (e.g., air handler) connected to a fitting 202 (e.g., a tee) an on to the drain line 206.

Figure 3:
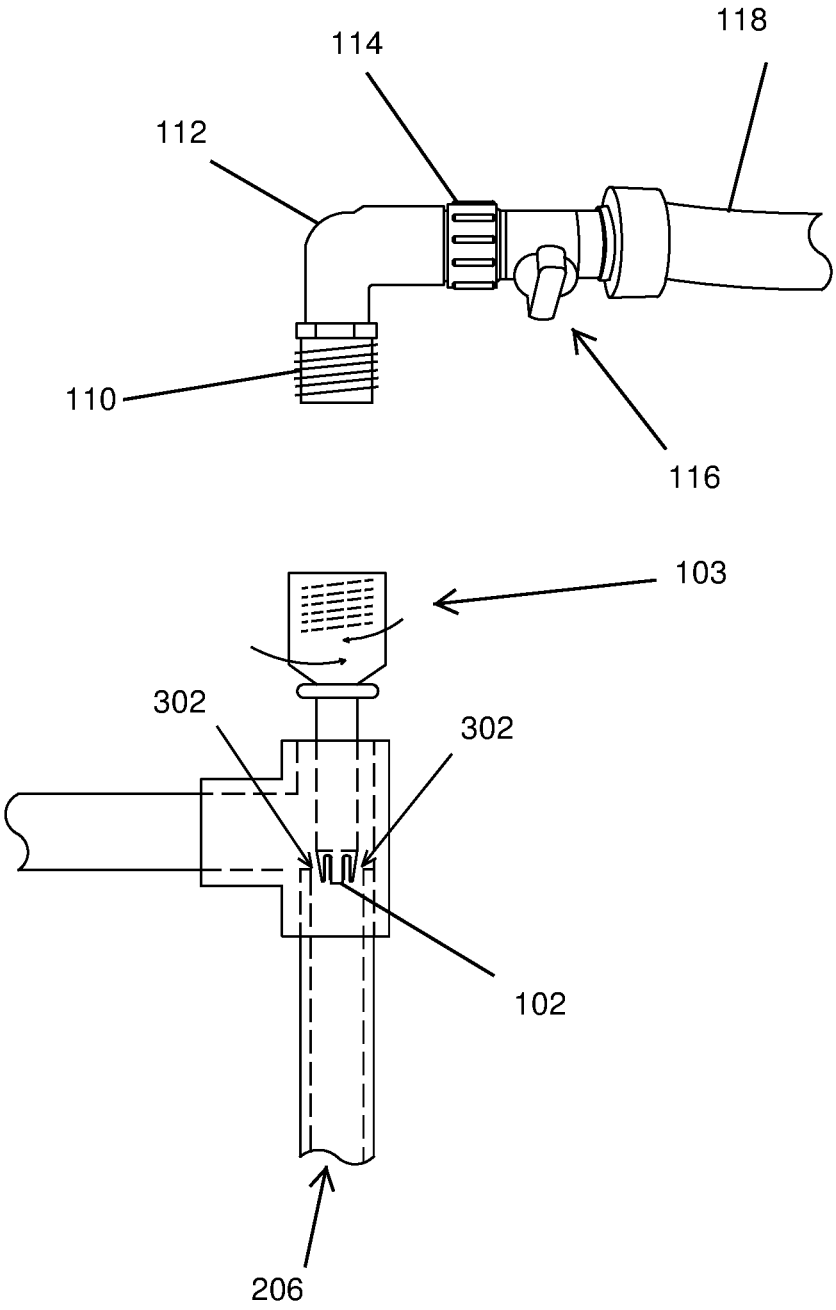
FIG. 3 shows a side elevation view of an example drain cleaning device being inserted into a drain line in accordance with some implementations.

FIG. 3 shows a close up view of the lower portion 103 being twisted within the drain line 206 to cause the tapered end 102 to help remove excess adhesive 302 when the lower portion 103 is rotated within the drain line 206.

Figure 4:
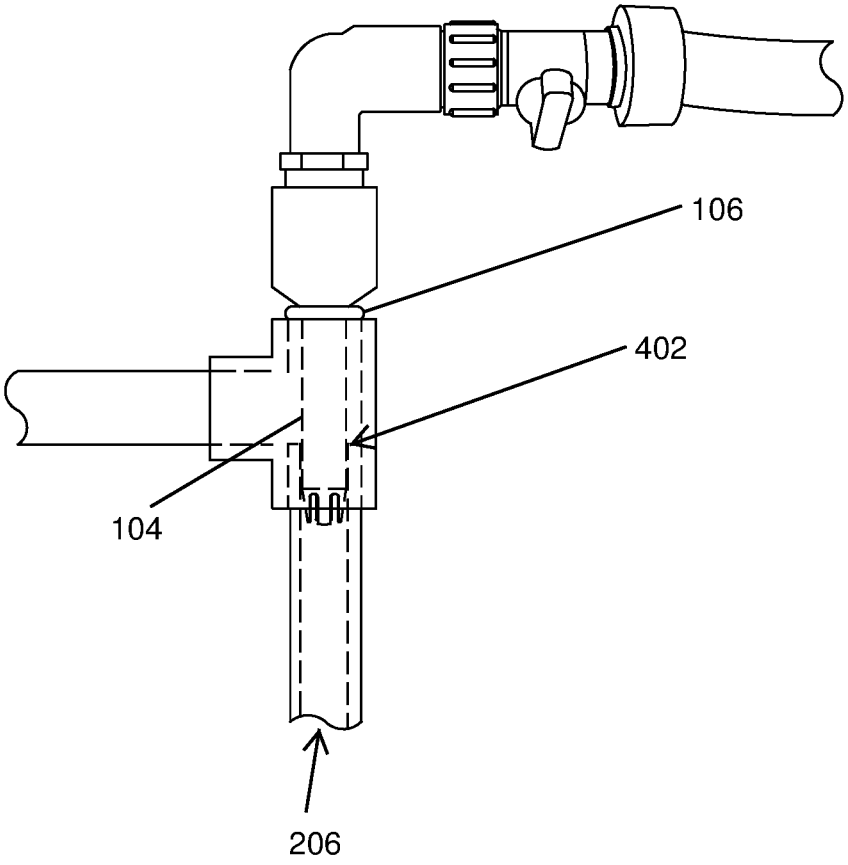
FIG. 4 shows a side elevation view of an example drain cleaning device inserted into a drain line in accordance with some implementations.

FIG. 4 shows the lower portion 103 inserted into the drain line 206 such that the tapered end 104 engages the top of the drain line 402 in an interference fit and the elastomeric seal 106 engages the top of the fixture 202 to help provide a seal to prevent cleaning fluid from leaking from the drain line cleaning device when in use cleaning a drain line 206.

In operation, fluid (e.g., water, cleaning solution such as a bleach solution, etc.) can be sprayed into the drain line 206 by the pressurized tank 126.

Figure 5:
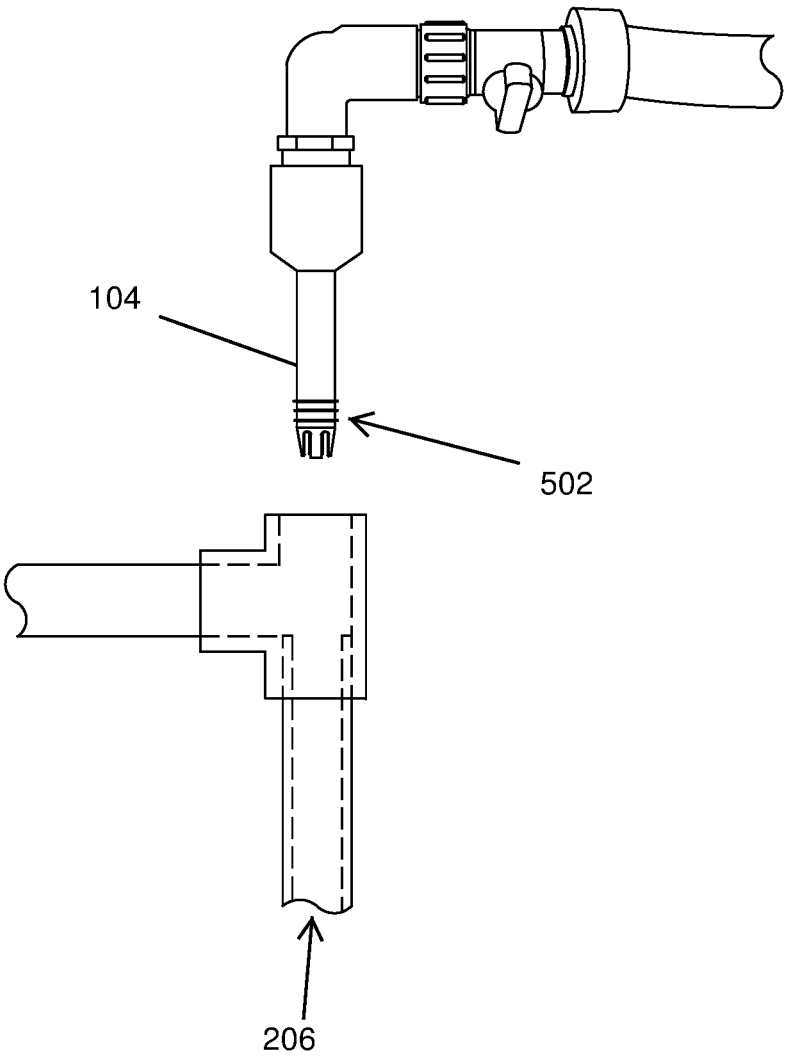
FIG. 5 shows a side elevation view of an example drain cleaning device with flexible baffles in accordance with some implementations.

FIG. 5 shows an example tapered end 104 having one or more flexible baffles 502 that are operable to engage the inside wall of a drain line (e.g., 206) and help create a seal to prevent cleaning fluid from escaping around the tapered end 104.

Figure 6:
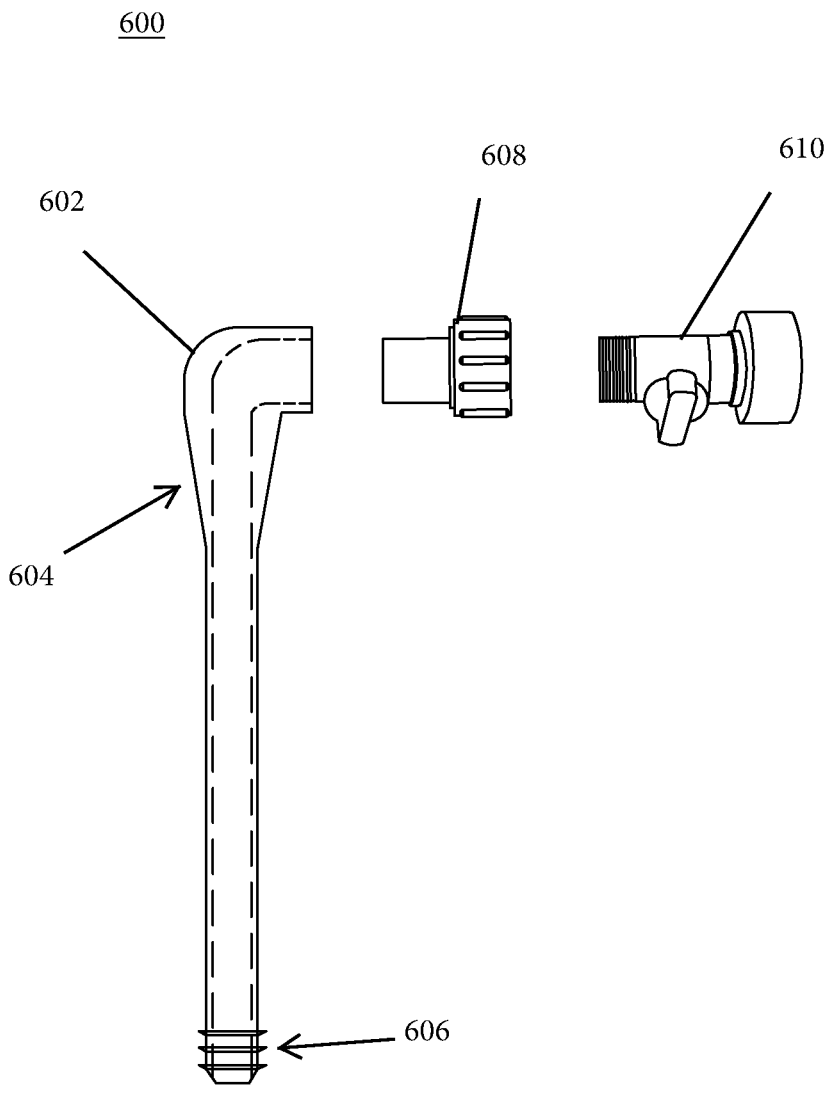
FIG. 6 shows a side elevation view of an example drain cleaning device with flexible baffles in accordance with some implementations.

FIG. 6 shows an exploded view of a removable lower section 600 of a drain line cleaning device in accordance with some implementations. The removable lower section 600 includes an integrated angle 602 (e.g., a 90 degree), a tapered portion 604, a plurality of flexible baffles 606, a threaded coupler 608, and a valve 610.

The tapered portion 604 is constructed from a flexible material (e.g., neoprene rubber) to create a seal when inserted within an interior of a condensate drain line.

Figure 7:
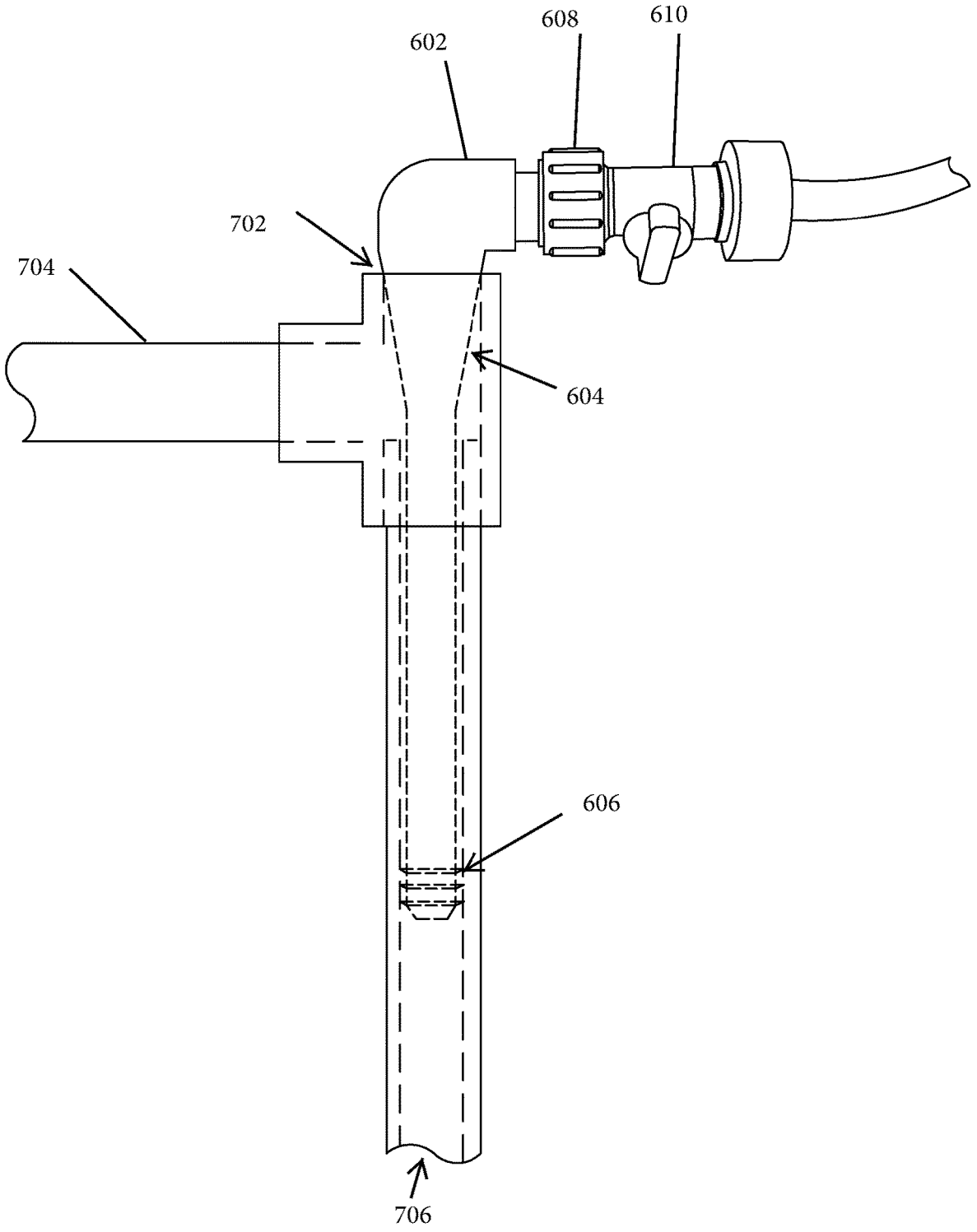
FIG. 7 shows a side elevation view of an example drain cleaning device with flexible baffles inserted into a drain line in accordance with some implementations.

FIG. 7 shows a side elevation view of an example drain cleaning device with flexible baffles inserted into a drain line in accordance with some implementations. FIG. 7 shows an integrated angle 602 (e.g., a 90 degree), a tapered portion 604, a plurality of flexible baffles 606, a threaded coupler 608, and a valve 610, a top of the drain line 702, a condensate line 704 from the equipment (e.g., air handler), a drain line 706.

The lower portion 600 inserts into the drain line 706 such that the tapered portion 604 engages the top of the fixture 702 to help provide a seal to prevent cleaning fluid from leaking from the drain line cleaning device when in use cleaning a drain line 706.

Figure 8:
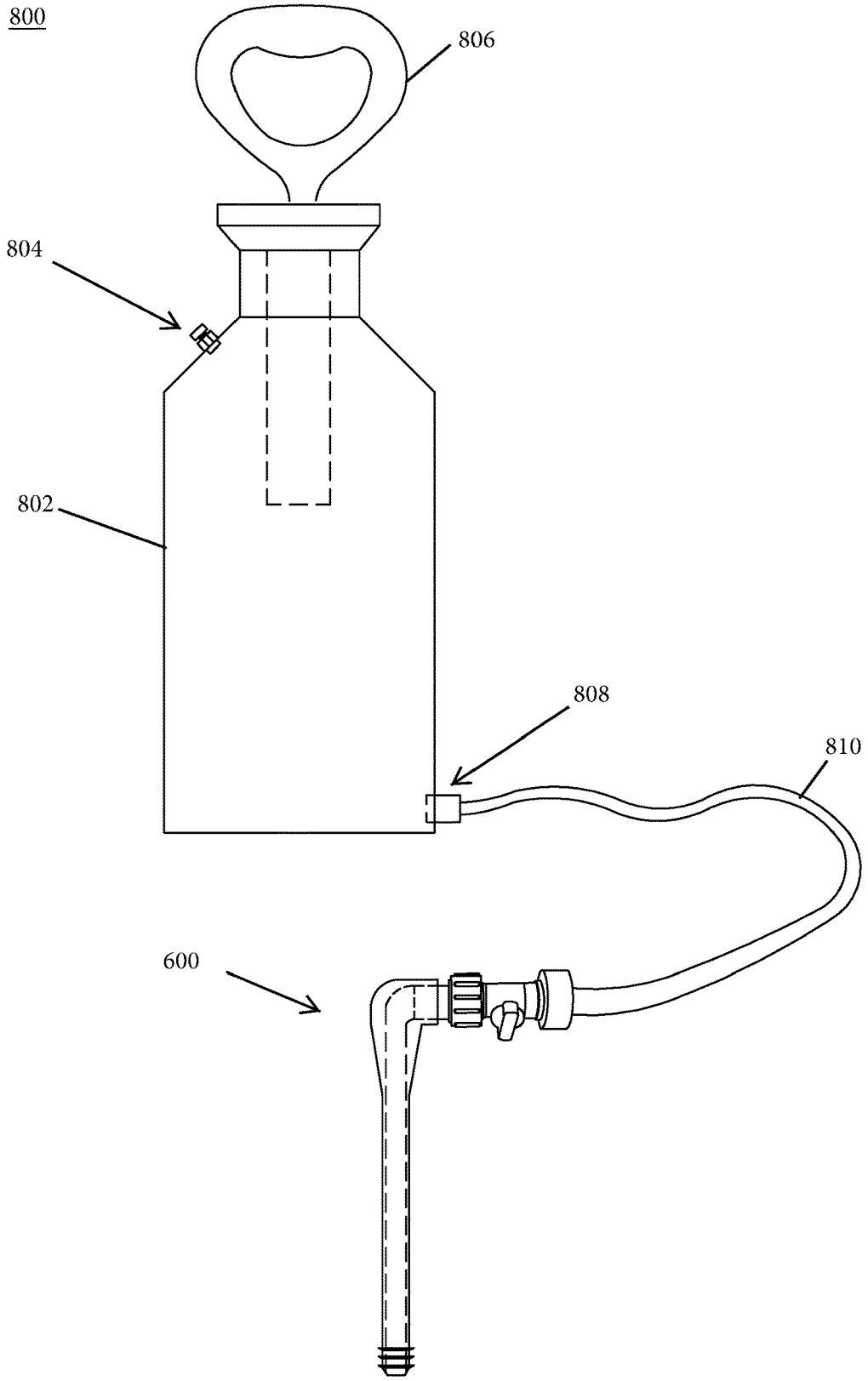
FIG. 8 shows a side elevation view of a drain cleaning device in accordance with some implementations.

FIG. 8 shows a side elevation view of a drain cleaning device in accordance with some implementations. The drain line cleaning device 800 include a lower portion 600, a tank body 802, a pressure relief valve 804, a pump 806, an outlet 808, and a hose 810.

Figure 9:
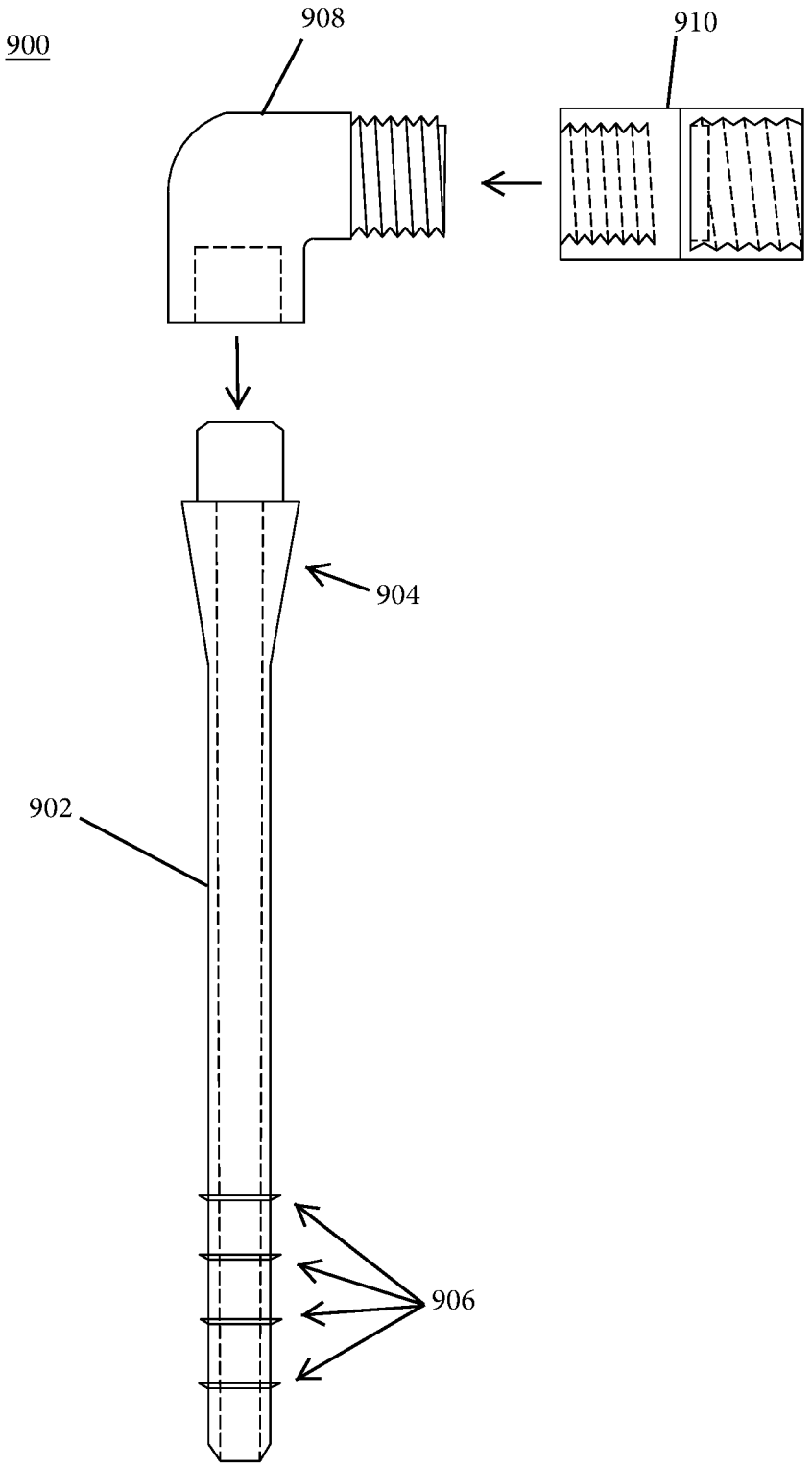
FIG. 9 shows a side elevation view of an example drain cleaning nozzle section with flexible baffles in accordance with some implementations.

FIG. 9 shows a side elevation view of an example drain cleaning nozzle 900 with flexible baffles in accordance with some implementations. The drain cleaning nozzle 900 includes a cleaning nozzle 902, a tapered portion 904, a plurality of flexible baffles 906, an angled connector 908 (e.g., a 90 degree), and a threaded coupler 910.

It is, therefore, apparent that there is provided in accordance with the presently disclosed subject matter, a drain line cleaning nozzle. While this disclosed subject matter has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of the disclosed subject matter.

What is claimed is:

1. A drain line cleaning nozzle comprising:

a first end;

a cylindrical portion connected to the first end, wherein the cylindrical portion of the nozzle has a diameter that is configured to fit within a plumbing connection and includes one or more flexible baffles configured to engage a sidewall of a drain line inserted into the plumbing connection to provide a seal at a first area;

a tapered portion connected to the cylindrical portion, wherein the tapered portion is constructed from neoprene and is configured to extend past an opening of the plumbing connection and create a seal at a second area different than the first area when the tapered portion engages the opening of the plumbing connection via interference fit; and a second end connected to the tapered portion, wherein the second end of the nozzle is configured to couple to a hose via an intermediate member;

wherein the tapered portion is offset from the second end of the nozzle and is configured to fit within a plumbing connection and engage, via an interference fit, an opening of the plumbing connection to provide the seal at the second area.

2. The drain line cleaning nozzle of claim 1, wherein the cylindrical portion of the nozzle having a length of 9±1 inches, wherein the cylindrical portion having an outer diameter of about 0.7±0.2 inches and an inner diameter of 0.5±0.1 inches.

3. The drain line cleaning nozzle of claim 1, wherein the intermediate member is configured to couple to a valve, and wherein the valve is configured to couple to a hose.

* * * * *